US005259617A

United States Patent [19]

Soong

[11] Patent Number: 5,259,617

[45] Date of Patent: Nov. 9, 1993

[54] GOLF CLUB HAVING SWIVEL FACILITATING MEANS

[76] Inventor: Tsai C. Soong, 1839 Jackson Rd., Penfield, N.Y. 14625

[21] Appl. No.: 821,809

[22] Filed: Jan. 17, 1992

Related U.S. Application Data

[63] Continuation-in-part of Ser. No. 802,739, Dec. 5, 1991, abandoned.

[51] Int. Cl.[5] ..... A63B 53/02

[52] U.S. Cl. ..... 273/80.2; 273/193 R; 273/80 B; 273/186.2; 273/79

[58] Field of Search ..... 273/80.2-80.8, 273/80 B, 193 R, 193 B, 194 R, 77 R, 77 A, 80 R, 79, 186.1, 186.2

[56] References Cited

U.S. PATENT DOCUMENTS

| | | | |
|---|---|---|---|
| 695,579 | 3/1902 | Parmele | 273/80.2 |
| 1,428,015 | 9/1922 | Dienner | 273/193 B |
| 1,471,794 | 10/1923 | Leven | 273/193 R X |
| 1,529,305 | 3/1925 | Gatke | 273/193 B |
| 1,684,278 | 9/1928 | Horne | 273/80.2 |
| 1,713,158 | 5/1929 | Anderson | 273/79 |
| 1,876,657 | 9/1932 | Fox | 273/193 R |
| 1,879,117 | 9/1932 | Davidson | 273/79 |
| 2,691,525 | 10/1954 | Callaghan | 273/79 |
| 2,992,828 | 7/1961 | Stewart | 273/80 B |
| 3,215,437 | 11/1965 | Webb | 273/193 R X |
| 3,229,980 | 1/1966 | Silberman | 273/186 A |
| 3,341,202 | 9/1967 | Stars | 273/77 R |
| 3,428,325 | 2/1969 | Atkinson | 273/193 R X |
| 4,118,033 | 10/1978 | Miyamoto | 273/186 A |
| 4,580,785 | 4/1986 | Toku | 273/80 B X |

FOREIGN PATENT DOCUMENTS

| | | | |
|---|---|---|---|
| 43-26055 | 9/1968 | Japan | 273/80 R |
| 8864 | of 1892 | United Kingdom | 273/79 |
| 7615 | of 1903 | United Kingdom | 273/80 R |
| 1819 | of 1915 | United Kingdom | 273/80.3 |
| 313337 | 6/1929 | United Kingdom | 273/80.3 |
| 2233566 | 1/1991 | United Kingdom | 273/80 B |

*Primary Examiner*—V. Millin
*Assistant Examiner*—Sebastiano Passaniti
*Attorney, Agent, or Firm*—Bernard A. Chiama

[57] ABSTRACT

A golfclub is disclosed as having a shaft connecting a golf head at one end to a handle at the other end. The golf head has a hitting face arranged for contact with a golfball, and is connected to the end of the shaft by a hinge having its pivot axis arranged so that the hitting face is always perpendicular to the direction of movement of the golf head during swinging of the golfclub. A wire is arranged within the shaft being connected at some point within the handle of the golfclub and to the golf head adjacent the pivotal axis therefor. The neutral axis of the shaft and the wire define the two long legs of a four-bar linkage formed as a parallelogram which includes as the short legs, the distance between the hinge axis and the connection of the wire to the golf head, and the distance of the connection of the wire at the other end thereof to the handle and the adjacent end of the neutral axis. By virtue of this arrangement, for any swing amplitude of the golfclub during play, the plane of the hitting face will always be perpendicular to the direction of the movement of the golf head.

7 Claims, 9 Drawing Sheets

GOLF CLUB HAVING SWIVEL FACILITATING MEANS

This is a continuation-in-part application of the previously filed patent application Ser. No. 07/802,739, filed on Dec. 5, 1991 now abandoned.

BACKGROUND OF THE INVENTION

A conventional golf club has a tapered shaft, the larger end having a grip used for a handle, and the smaller end is connected to a head used for striking a ball. The head is heavy compared to the shaft. A steel shaft, not including the rubber grip, is about 110 gm. The head is about 210 gm for a #1 wood which is the driver for the longest distance. Even for the so-called irons, which are medium range golf club, the head is still much heavier than the shaft. The reason for a heavy head is that the greater momentum upon hitting the ball will drive the ball farther.

Among design parameters, besides the length and the taper of the shaft, its weight distribution and shape of the head, another important design parameter is the so called angle of the hitting face of the head. Hitting face is the generally flat surface of the head which provides the impact surface with the ball. The tangent plane of the hitting face is the tangent plane at the point on the face with the minimum curvature. The tangent plane is an inclined plane, making an angle with the axis of the golf club and is also tilted with respect to the ground when the golf club is held in position ready to strike. The tilting angle of the hitting face is responsible for the ball to fly at an inclined angle to the ground level. If the hitting face angle is zero, the ball will travel parallel to the ground level. This tilting angle varies from several degrees to twenty degrees or more. Different golf club manufactures have different ways and conventions to define that angle. Since the golf club is a slender, tapered shaft which is flexible and with most of the curvature during swinging is derived from the slender part of the shaft near the head, the true inclination angle the hitting face of the head is making with respect to the ball when it hits is an unknown. Most likely it is a much greater angle than what is designed for.

It is known that the swing of a golf club lasts only a fraction of a second, about 3 to 4 tenth of a second, before the head hits the ball. The impact lasts only about 0.001 second or even less. In that short time period, it is not possible to have an on-course correction of the swing of the shaft to maneuver it so that when the ball is hit, the shaft is straight and the head is hitting at the ball at an angle equal to the angle of the hitting face. Only through practice, a golfer will know how to swing the golf club and how much force is to be applied for the desired optimum condition. Each pro has its own ways to compensate for this problem, but for the majority of ordinary players, their scores vary from day to day due to this difficulty.

The present invention explains what is going on in that fraction of a second during the swing of the golf club and proposes to have a facilitating means in the golf club that will automatically improve the control of the inclination angle of the hitting face of the head at impact time so that every swing turns out to be a good swing for ordinary players.

DESCRIPTIONS OF THE DRAWINGS

For the purpose of illustrating the invention, there is shown in the drawings forms which are presently preferred, it being understood however, that other embodiments not shown may fall within the realm of the invention if the underlying principle of the invention applies.

The figures are:

FIG. 1. shows a conventional golf club.

FIG. 4A—A is a side view taken along the line A—A in FIG. 4A.

Figure 5:
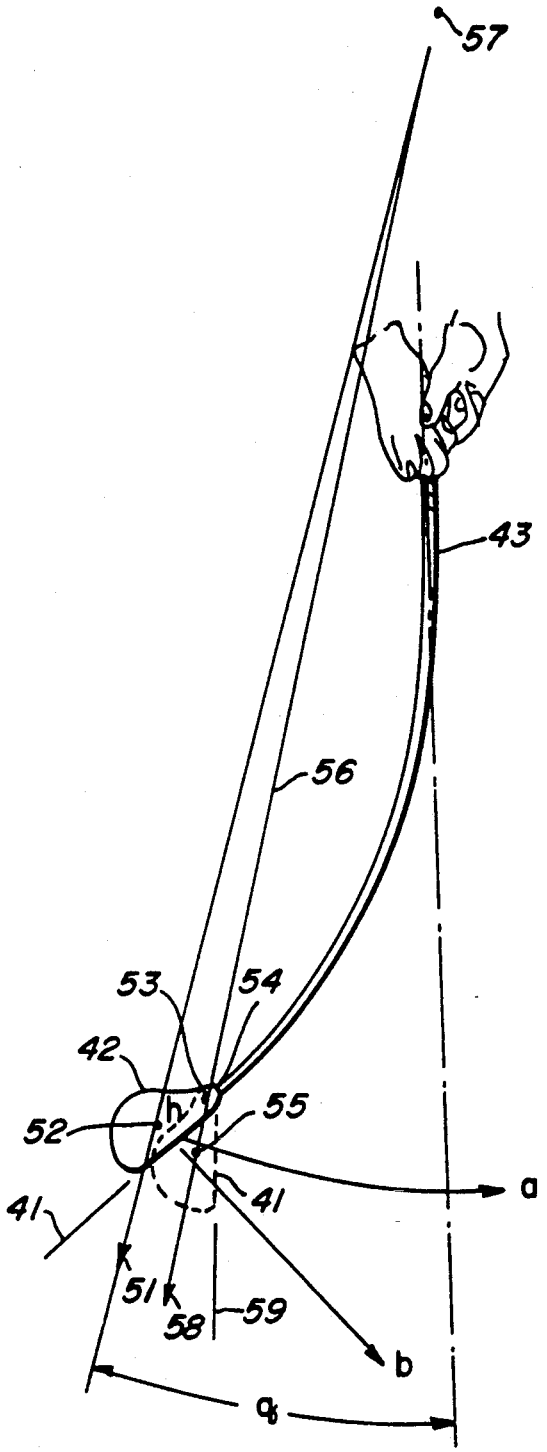

FIG. 5 shows action of facilitating means.

Figure 6:
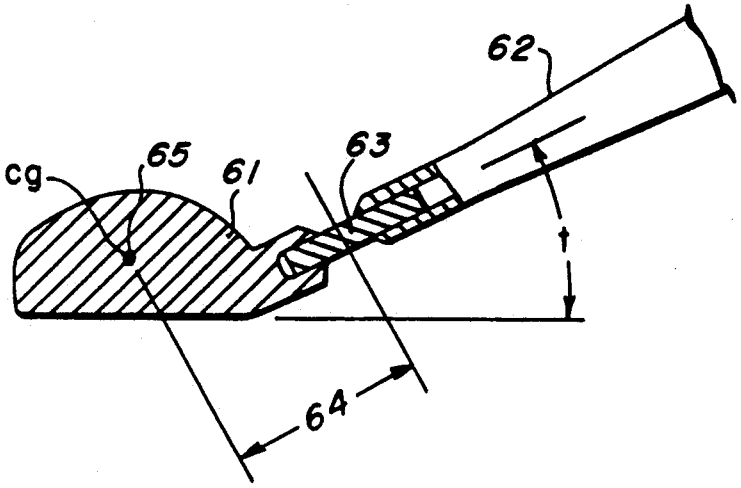

FIG. 6 shows an embodiment of facilitating means.

Figure 7:
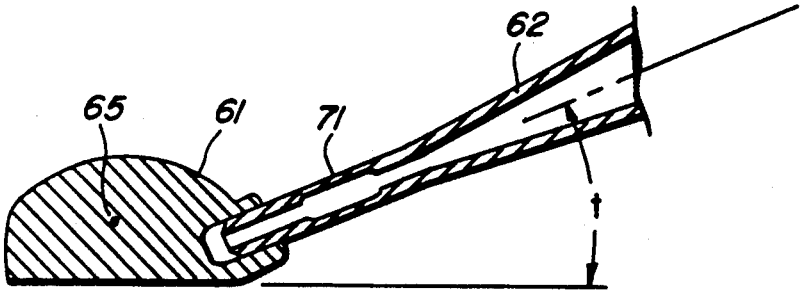

FIG. 7 shows another embodiment of facilitating means.

Figure 8:
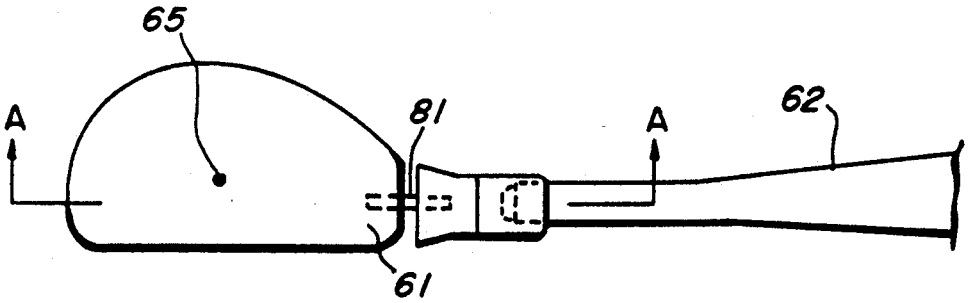

FIG. 8 shows another embodiment of facilitating means.

FIG. 8A—A is a cross-section of FIG. 8 along A—A.

Figure 9:
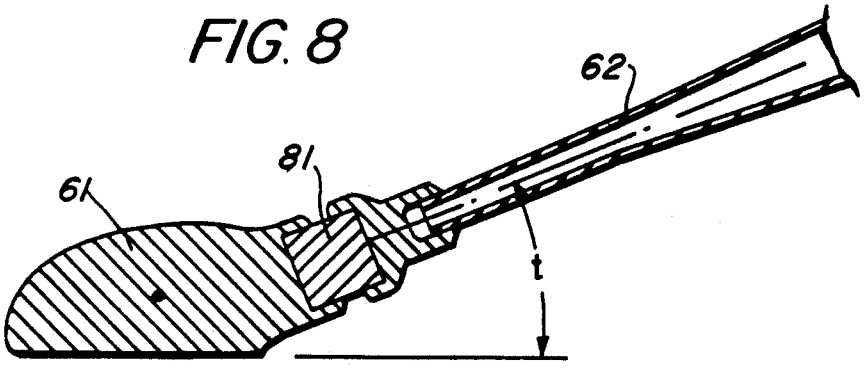
Figure 9:
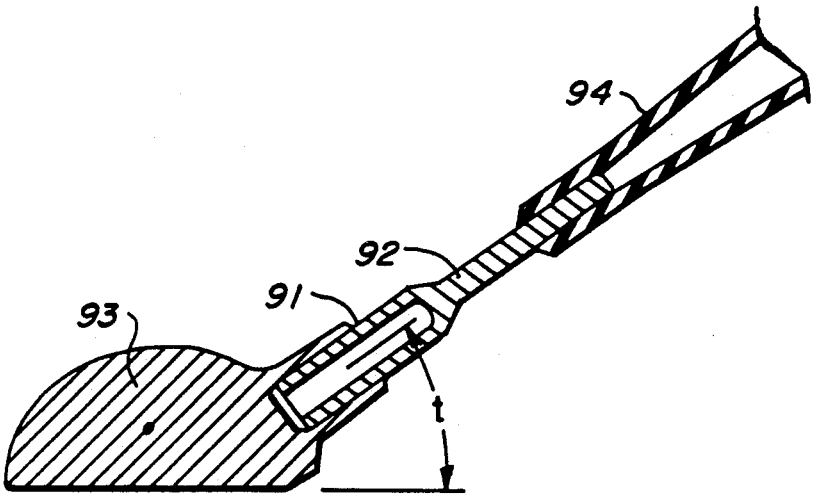

FIG. 9 shows yet another embodiment of facilitating means.

Figure 10:
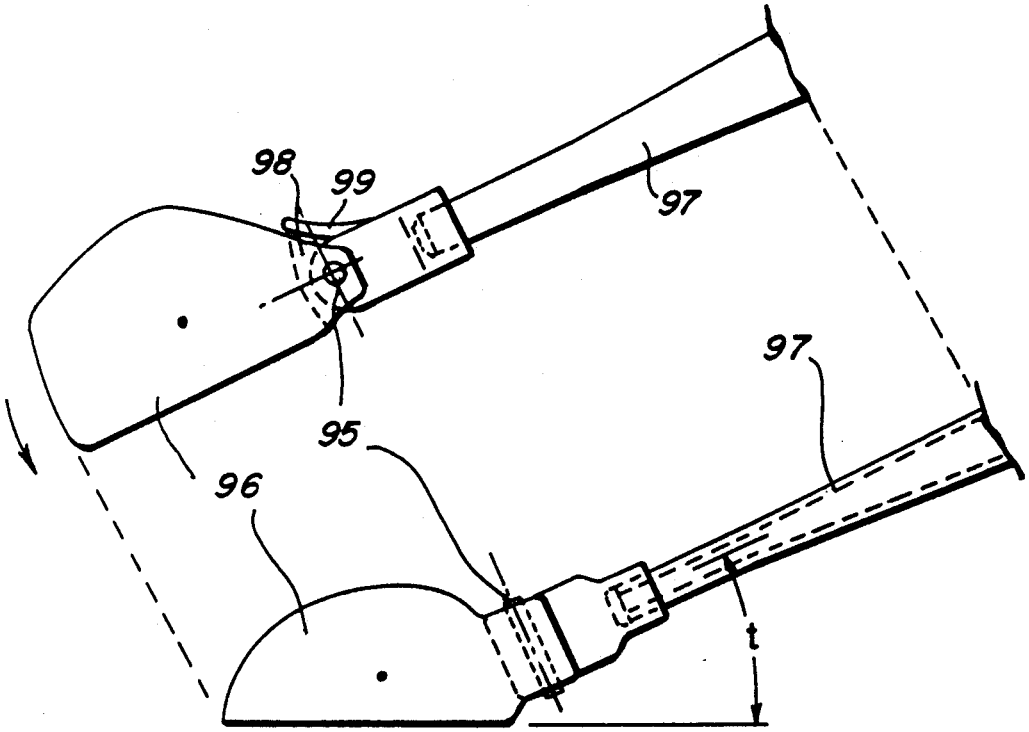

FIG. 10 shows a hinged facilitating means.

Figures 11A, 11B, 11C:
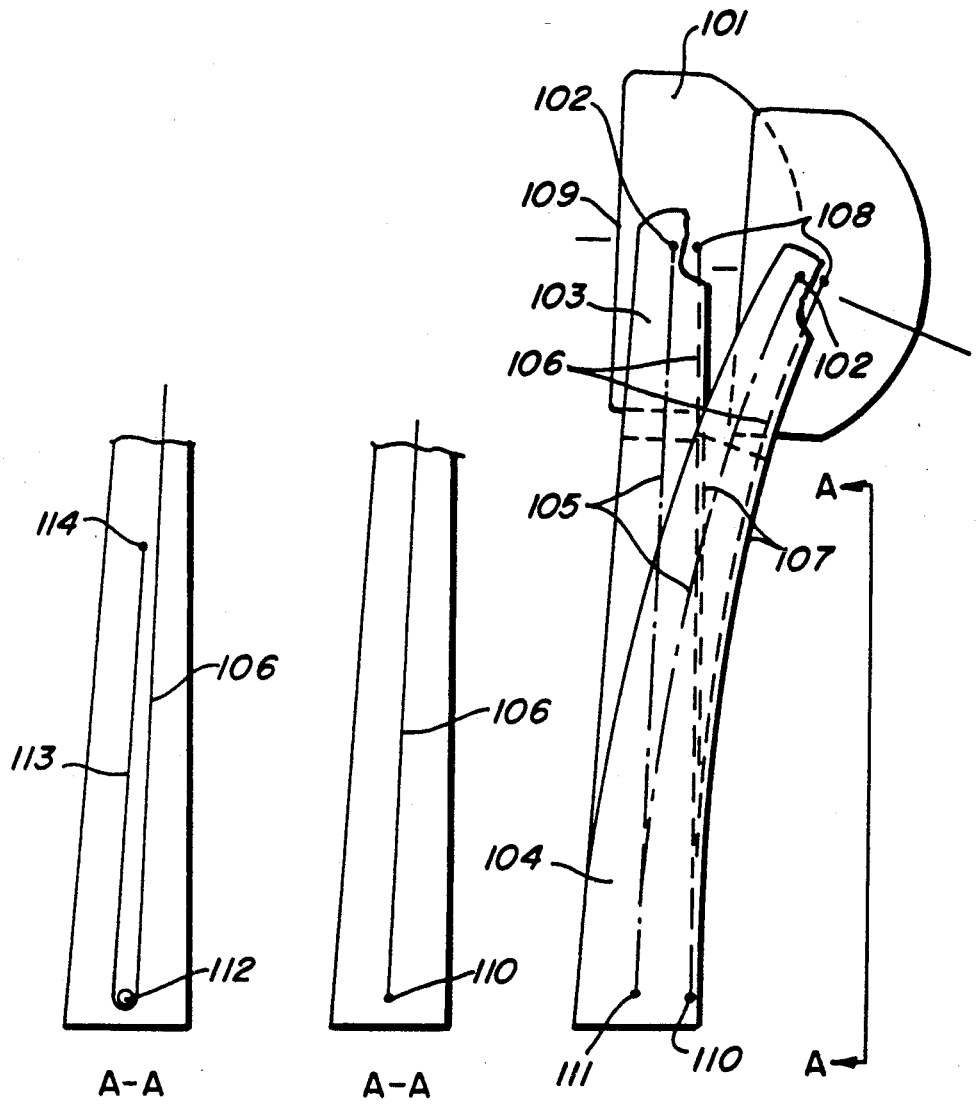

FIGS. 11A, 11B and 11C show a preferred embodiment.

Figure 1:
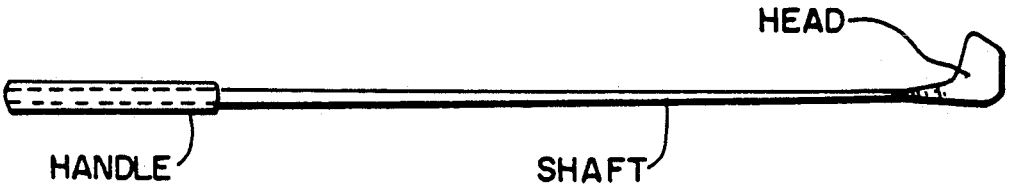

In the figures shown, FIG. 1 is if conventional golf club which has a long tapered shaft with a handle fitted with a rubber grip at one end and a heavy head at the other end. The shaft is generally tapered as shown, commonly used material for the shaft at the present is steel and fiber-reinforced material.

Flexibility of the shaft is important to the final speed of the head when it hits the ball. Experts in golf all agree that as a rule of thumb, and given equal head weight, the more flexible the golf club shaft, the more it will help generate head speed; the stiffer the shaft, the more it will help to deliver the head face to the ball accurately. All manufacturers have their own ways to design flexibility, weight, and hitting face angle to suit a widely different classes of players. Different experts give different advices from their own experience how to hit the ball. It all amounts to how to compensate for the limitations of existing golf clubs.

The inventor has developed a complicated mathematical analysis to study the swing of a golf club. The finding is believed to be the first in the analysis of golf club dynamics. The result revealed very interesting data and offers understandable explanations to the techniques of playing golf as have been given by golf experts in the past.

Figure 2:
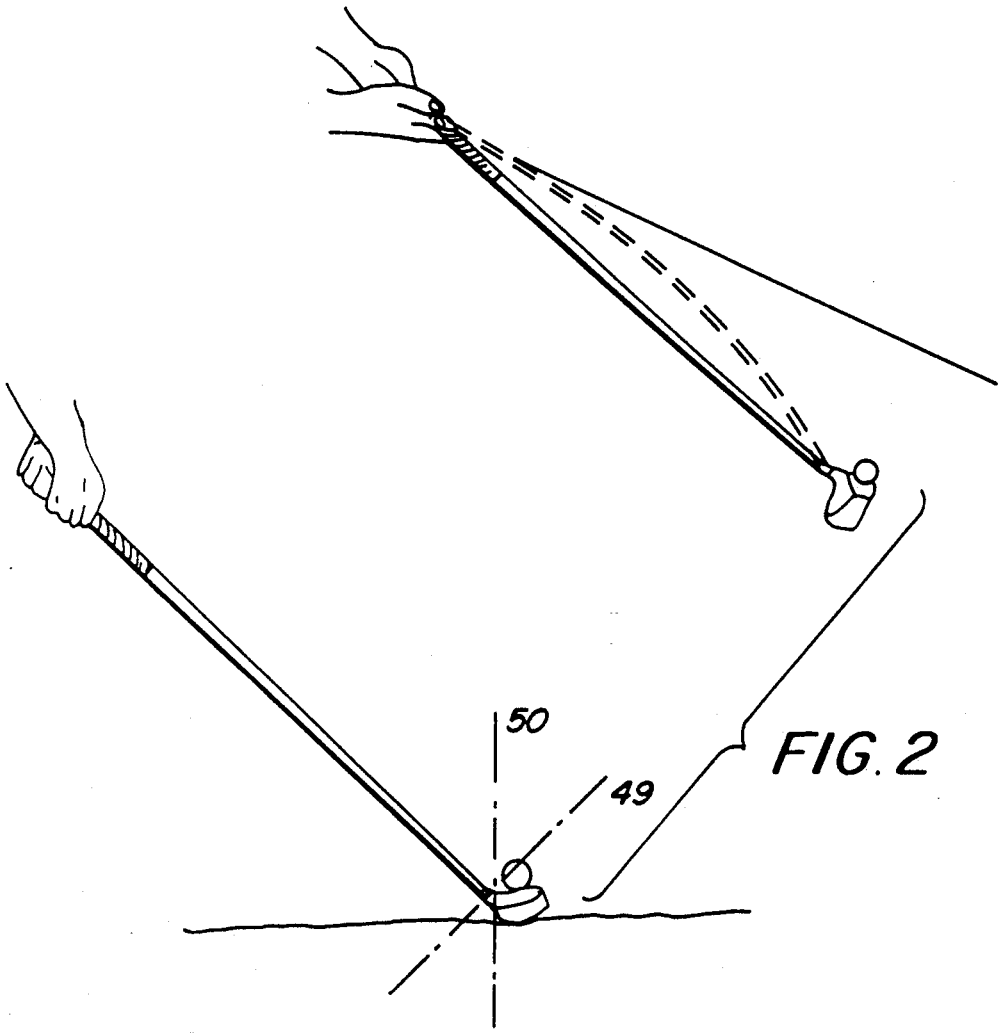
FIGS. 2A and 2B are sketches of the swinging plane.
Figure 3A:
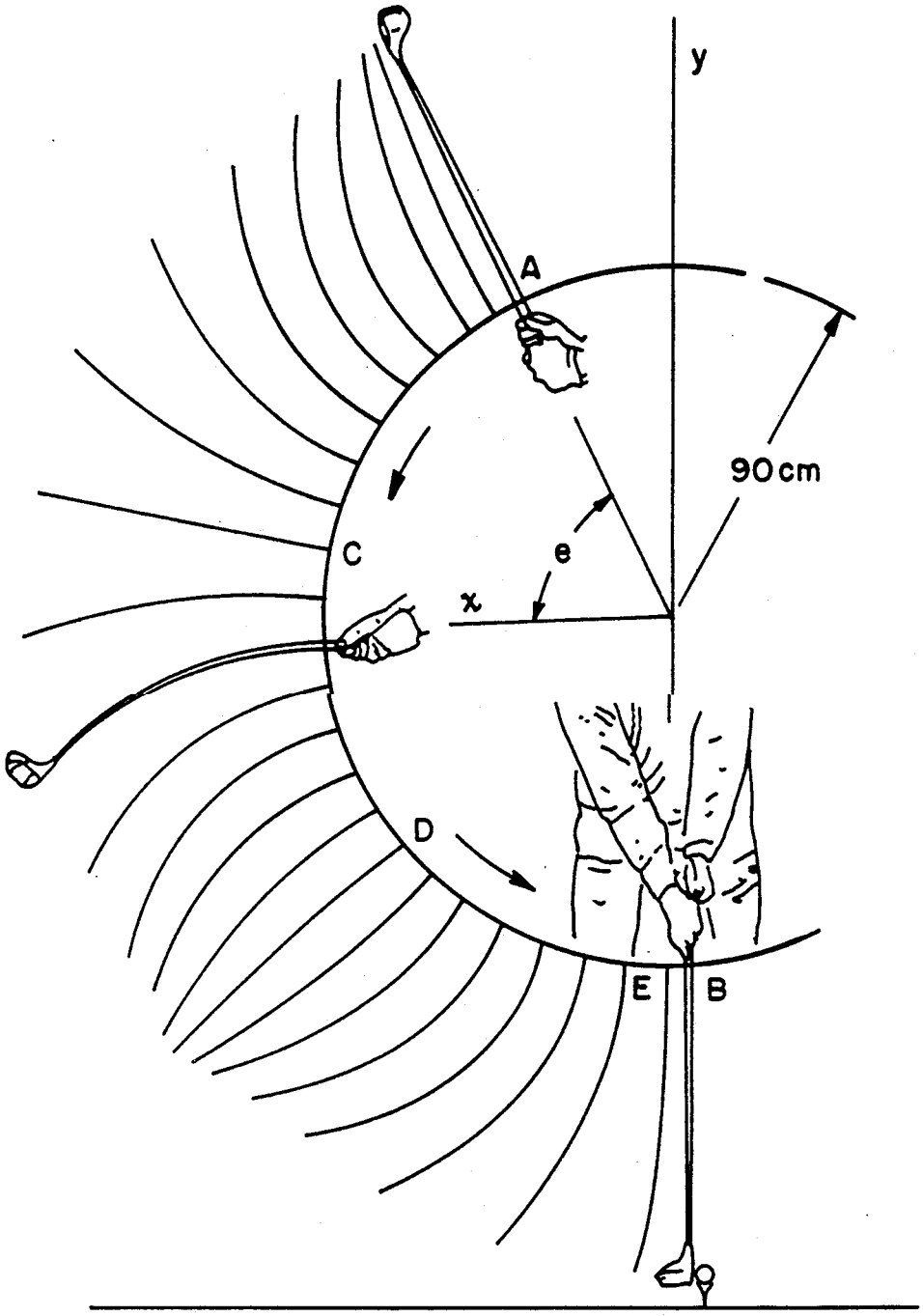
FIG. 3A shows a computer result of the trajectory of a swinging golf club.

FIGS. 2A and 2B show the inclination plane in space where the golf club is being swung and its deflections and trajectory are studied. The upper sketch FIG. 2A is the front view of the plane which will be called the sweeping plane which the golf club shaft is making just before hitting the ball. Axis 49 is perpendicular to the shaft and axis 50 is perpendicular to the ground. These axes will be discussed in FIG. 4. FIG. 3A is a case study of a standard stainless steel golf club having a head weight of 210 gm, Shaft length 83 cm, measured from a point in the handle to be the beginning end of the flexible shaft to the beginning end of the head. The center of gravity of the head is 8 cm away from the second end of the shaft. The outer diameter of the shaft at the handle side is 15.5 mm, the outer diameter of the tube at the head side is 8.5 mm and the wall thickness is 0.369 mm. These data completely defined the geometry of the golf club sample.

Suppose the golfer begins his downward swing at point A in FIG. 3A, with a constant acceleration until his hand reaches a constant angular velocity. There are several modes how people play. One way has been chosen to study as a sample. The movement of the head will have to be governed by the movement of the hand. Two parameters govern the solution: one is the angle e the point A makes with the x-axis, which is parallel to the ground. The other is the prescribed speed profile of the handle.

FIG. 3A is from a computer output plotting from the dynamic analysis program which shows deflected shapes of the shaft at various points at the trajectory where angle e, in this case, is 65 degrees. Notice that in this case, with the speed profile prescribed, the shaft becomes straight again when it reaches the lowest point B, and hits the ball. To do that the golfer has to be a very experienced player. He has to exert the right amount of force in the hand to accelerate the handle. The time elapsed is 0.326 seconds. This speed at the head is the maximum because all the bending strain energy stored in the shaft, gaining and losing during swaying backward and forward, are having negative effect on the head speed. Only when the shaft becomes straight, the bending energy acquired at the beginning of the downward swing is converted into dynamic energy of the head. Its speed is then maximum. Any bending of the shaft stored in the system will eventually help the head to gain speed when it becomes straight, provided that the golfer knows when to swing and how hard to swing. Therefore, the more flexible the shaft is, the higher the head speed it can get, when it is straight. But since the swing amplitude will be increased by a flexible shaft, control and accuracy would be more difficult. This analysis explains why a stiffer shaft is good for control but flexibility is good for speed.

FIG. 3A also explains why an inexperienced golfer will find a flexible shaft difficult for control. Note that the head is swaying all the way along the trajectory. An inexperienced golfer may start from A at an angle e different than 65 degrees, and use the same force. He may also starts at 65 degrees, but using a larger or smaller force. In either case, he is very likely hitting the ball at a time when the shaft is not straight, say at E. Not only the head speed is lower at E, the worse thing that happened is that the hitting face angle is very much inclined at the moment when impacting the ball. The ball will be sent to an entirely different soaring angle. Since B and E is only one-hundredth of a second in time difference, the golfer will never know the reason why his ball is going wildly.

Figure 3B:
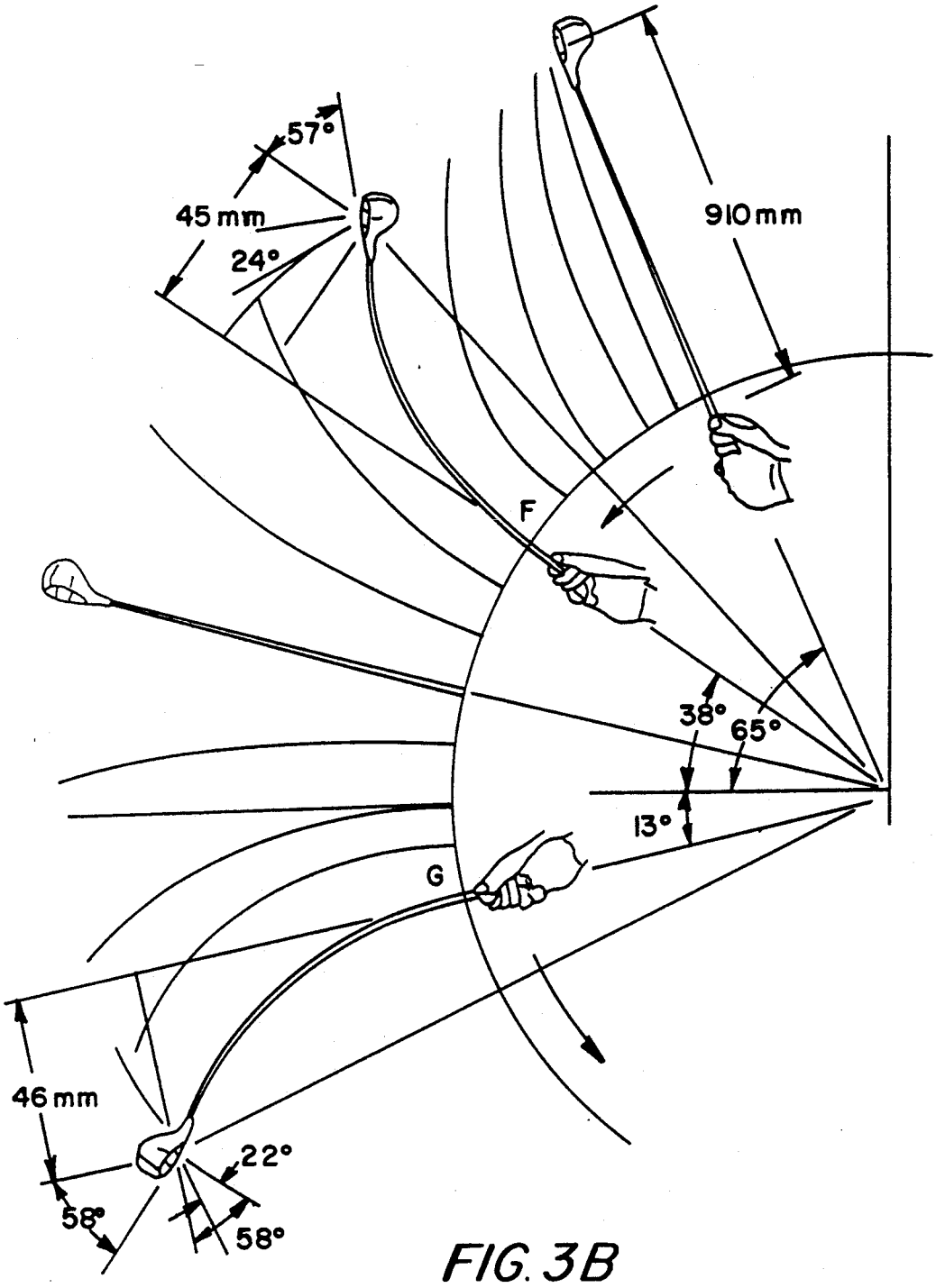
FIG. 3B shows more details of FIG. 3A.

FIG. 3B is taken from FIG. 3A for further discussion. At position F, the head is bent backward most. The head hitting face is making 24 degrees with the direction of motion of the head at that point. At point G, the shaft is bent most forward. The angle is 22 degrees. In most cases, the reduction in head speed is not crucial, but the hitting face pointing at a wrong direction, such the 24 and 22 degrees, is a much serious concern. Experienced players had ways to compensate for the problem just described. But lesser players can not. This is the most difficult technique facing inexperienced players.

As noted before, there are other swinging modes. For example, a constant acceleration to the end will produce much larger backward swaying than forward swaying.

Figure 4:
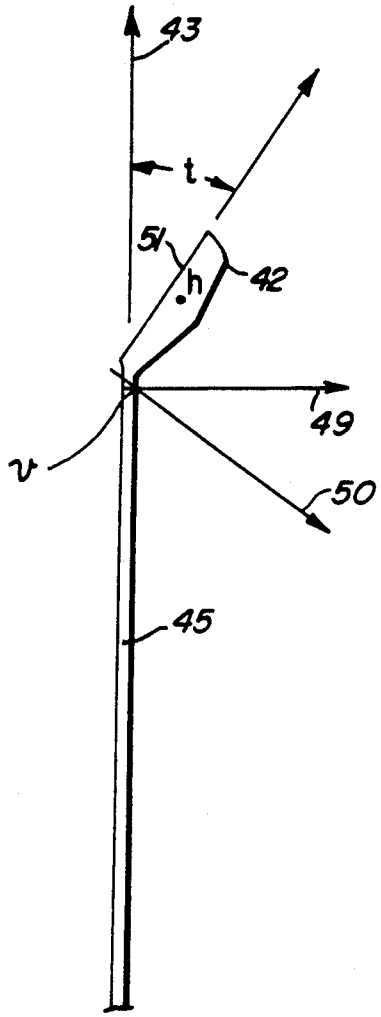
FIG. 4A shows angles of the curved shaft.
Figure 4:
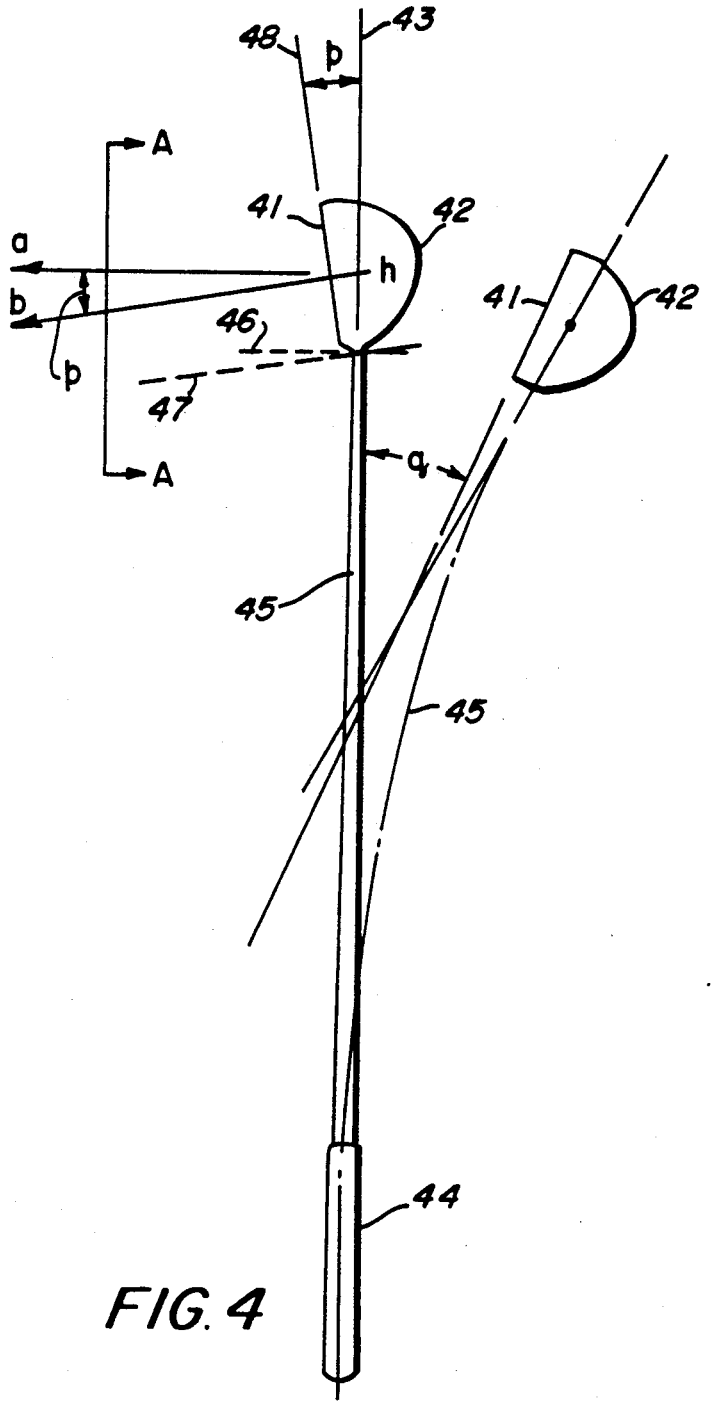

FIG. 4 shows the golf club projected to a horizontal plane which contains the shaft. The hitting face 41 of a head 42 makes an angle p with the longitudinal axis 43 of the handle 44 when the shaft 45 is straight. When the straight shaft hits a ball (ball is not shown), the head 42 is travelling along the tangential direction of a as shown. The hitting face with an inclined angle will send the ball to the desired direction b as shown. All the geometries are shown in a projected sense. When the shaft 45 is curved due to the swinging of the golf club, the projected hitting face 41 is now making a much larger angle q with the same handle axis 43. This will greatly alter the ball's direction upon hit. The prior art does not consider and does not compensate for the situation when the shaft is curved due to swinging and the direction of the hitting face is disoriented. All players have to cope with that problem by themselves.

The hitting face of the head has other orientation angles making with different planes, not just the projected angle p noted here. For different golf club, the head could be tilted upward for another angle t, see FIG. 4B, which is a clockwise turn about an axis 46 which passes through a point v in FIG. 4B. This upward angle may be about axis 47 which same plane as 46 but is normal to the hitting face 41. A third angle is a tilt about an axis 48 which is again in the same plane but is perpendicular to 47. This tilt angle is not shown. The tilt angle is a loft angle that lofts the ball to an upward angle when hit, making the ball soaring to a height.

The axis perpendicular to the horizontal plane in FIG. 4A, which is called the swinging plane of the golfshaft in this text, is shown as 49 in the FIG. 4B view. This swinging plane contains the shaft axis 43 and is perpendicular to axes 46, 47 and 48. Another axis perpendicular to 48 is 50 which is also perpendicular to the ground plane which is the bottom plane parallel to the bottom of a golf club head. Axes 49 and 50, referred to as turning axes, will be discussed related to the rotation of the golfhead through facilitating means. These two axes are preferred turning axes for the head to turn, made in the facilitating means. That axes 46, 47, 49 and 50 are preferred to intercept the axis of the handle 44.

In this application whenever the angle of the hitting face is mentioned, it refers to the projected angle p made by the generally flat hitting surface 41 with the extended longitudinal axis 43 of the handle whereby the shaft is lying on a horizontal plane and the head is ready to move horizontally to hit the ball as shown in FIG. 4.

For simplicity but without loss of generality, assume a golf club with the angle p as zero and is bent backward severely as in FIG. 5. This deflected shaft is in position F in FIG. 3B. The invention is having facilitating means, which can be a part of the shaft, or a part of the head, or a distinctive unit, having two ends joining the shaft and the clubhead, If the end connecting to the shaft is #1 end, with axial coordinate L1 and the other end connecting the head is #2 with coordinate L2, and assuming a bending moment M is applied at the head which bends the golf club all along its axis, the slope of the center line at every point along the axis of the golf club will be increased. Assume the slope angle of the handle is zero, then the slope of the shaft is increasing up to the head.

Mathematically, it can be written $$C(12) = \frac{R(2) - R(1)}{M} = \int_{L1}^{L2} \frac{dL}{EI} \quad (1)$$

where R(2) and R(l) are the slopes of the facilitating means at L2 and L1 respectively and dL is the differential length along the coordinate. The quantity [R(2)−R(l)]/M is the change in slope between L2 and Ll for unit bending moment. Therefore, the absolute magnitude M is not important for the value of C(12) needed for comparison of the bending between the facilitating means and other portions of the shaft of equal length. The bending rigidity EI varies along axis. Bending rigidity will be defined later in FIG. 6. EI for soft material and slender shaft is small. For a hinge, it is zero. Therefore, the right-hand side quantity integrated (or the algebraic sum of differential length from Ll to L2) is a large number for the facilitating means, which means the slope changes greatly from Ll to L2, and should be small for the rest of the shaft measured anywhere for an equal length as [L2−L1]. The invention is to make this C(12) large enough for a practical length (from a few milimeters to a few centimeters) of the facilitating means.

Therefore, having made the head easy to turn about the shaft by means of the facilitating means, the centrifugal force 51 acting on the center of gravity 52 of the head 42 will turn the head in a counter-clockwise direction about an axis passing a point 53, which resides in the facilitating means 54. The rotation will stop until the displaced center of gravity 55 lines up approximately with the line 56 as shown. This line links 53 to the center point 57 which is the center of swing of the golf club. 53 is a turning center inside the facilitating means, which enables the golf club head to turn towards the handle. Along the new radial line 56, the centrifugal force 58 is now acting and maintaining force equilibrium. The direction line 59 of the displaced hitting face 41 is almost parallel to the axis of the handle 43. It can be seen that the facilitating means enables the head to turn in a direction opposite to the direction of the projected general curvature of the shaft when the shaft is being bent due to the swinging of the golf club, and most of the turning is accomplished within the facilitating means. The words "projected general" before the word curvature is used because, as we mentioned before in the text, there are several preferred turning axes for the head to turn about the shaft and they are perpendicular to different planes, but they all fit the description, if they are seen projected onto the swing plane. The curvative is qualified as general curvature because curvature is different for each point in the shaft and we mean the general shape. This is a unique feature. If a ball is at the hitting face at this moment, the impact will send the ball along the tangential line a as shown which the handle is aiming at, instead of along the normal of the earlier distorted hitting face.

The desirable axis of rotation for the head to turn by means of the facilitating means is either axis 49 or 50 or a direction in between in FIG. 4. However, since the geometry of a golf club varies substantially, angles t, p and the tilting angle are all different, other turning axis for facilitating means may be also desirable.

It should be pointed out that the orientation of a golf club head with respect to the shaft is complicated in terms of space geometry. Faces of the head are often not flat. Planes regarding faces of the head often are referred to in the approximate sense. If the head turns towards the shaft the tangent plane is meant, or other fixed plane on the head rotates about an imaginary pivot point towards the extended axis in the handle. It is understood that these axes may not meet exactly in space and mathematically there is no angle in between.

The following computation results will show that the centrifugal force is large enough to rotate the head. With a head weighs 210 gm, and a ball weights 42 gm, to hit the ball to a distance from a minimum of 90 meters to a maximum of 310 meters, the required ball speed at separation is from 34 to 63 m/sec, assuming a tilting angle of 25 degrees. The head speed at impacting the ball is from 20 to 33 m/sec. The total swinging time is from 0.394 second to 0.344 second and impact lasts only 0.0011 seconds. At that head speed, with a length of swing center 57 to the center of gravity 52 in FIG. 5 taken as 2.00 m, the centrifugal acceleration is from 200 to 545 M/sec/sec. The centrifugal force, for the head mass of 0.21 kg divided by 9.8 m/sec/sec, is from 4.3 kg to 11.7 kg. This force, even the lower one, is large enough to rotate the head.

If possible, the center of gravity of the head should be designed to be along the line joining the handle and the center of the facilitating means. The impact with the ball will slow down the head, but will not change the angle the hitting face of the head making with the axis of the handle because of the centrifugal force.

FIG. 6 shows a preferred embodiment, of facilitating means which joins the head 61 to the shaft 62. 63 is simply a shaft, preferably a circular tube, fixed at both ends with the two bodies it connects. Its bending rigidity, defined as the material's Young's modulus multiplied by its cross sectional moment of inertia, is small. Bending rigidity is equal to the bending moment required to bend the shaft for a unit change of its curvature. The bending rigidity for a bearing or a pivot is zero. A small bending rigidity makes it easier for the head 61 to turn about the shaft or tube 63. The distance, 64, which is the moment arm from the center of gravity 65 to the center of the shaft 63 affects the turning moment from the centrifugal force. Shaft 63 may be hollow and may be made of spring steel, plastics or fiber-reinforced composite materials, preferably of an advanced type which has low bending rigidity but high torsional rigidity so that an off-center impact by the ball will not twist the head about the centerline of the handle.

In FIG. 7, shaft 62 has a thin-walled neck at 71 as the facilitating means for the head 61 to turn about the shaft.

FIG. 8 shows the facilitating means is a resilient, flexible, plate-like element 81 joining the head and the shaft. It may be a plate of spring steel or fiber-reinforced component. It is preferred to be orthotropic, less in bending rigidity but strong in torsional rigidity.

FIG. 9 shows the facilitating means 91 which is partially hollow and a part of it 92 has low bending rigidity for the head 93 to turn about the shaft 94. Of course, 92 may be hollow to receive the shaft 94 instead of having 94 receiving 92.

FIG. 10 shows a hinge 95 which joins head 96 to shaft 97. The hinge may have bearings or have no bearings. The axis of the hinge may be axis 49 or 50 or along other orientation angles in that neighborhood. 96 can turn about 97 with no resistance. There should be elastic material, or spring device, adapted to control the head from the hinge in surrounding spaces 98 so that there is moderate control to restrain the head from rotating about the shaft prematurely or excessively. Workers in the trade would have no difficulty in such simple mechanical adaptations for the stated purpose. The pin may be substituted by other pivoting device. The difference between FIG. 10 and FIGS. 6 to 9 is that the head will turn about a point in the facilitating means as compared with a small highly curved region within the means. There may be an additional restrictive control 99 to limit the head movement when being thrown backward. As is being shown, it is a simple rigid bar stopping the head from leaning backward more than is allowed. Other ways are possible. This control will allow the head to turn about the shaft in a direction, projected to the swing plane, opposite to the curvature direction of the shaft, but not able to bend backward when the shaft is straight. So, when the shaft is straight and the head hits the ball, the impact will not push the head backward. This restrictive control may be adapted to all other embodiments. A special configuration in mind is for FIG. 8 and FIG. 10 embodiment wherein 81 is a thin elastic piece and 95 is a hinge, having a backplate similar to 99 to stop the backward movement when the shaft is straight and a thin piece of spring steel installed in at the opposite side of 99 so that the head is support falling forward when the shaft is straight. When the head is turning forwardly, the spring plate will be bent, but the resistance is not large enough to hinder the turning.

There are numerous ways to design the facilitating means. It is preferred that the facilitating means will hold the head steady along the center line of the handle even when the centrifugal force is small or even nonexist. Rubber material or torsional spring device may serve the purpose. There could be a control device in the facilitating means such that the facilitating means develops a resisting torque against rotation of the head during swinging of the golf club which is proportional to the amount of the reduction of the angle between the hitting face and the handle axis. A different kind of control device may permit the head to rotate only when the centrifugal force acting on the head exceeds a prescribed magnitude. Workers familiar with the art should have no difficulty to apply these well know and existing mechanical devices or material devices to accomplish the job.

It is also desirable that the hitting face inclination angle could be manually adjusted before swing to cooperate with the facilitating means for better performance.

The facilitating means adapted to the head may be made as an assembly readily adaptable to a golf club shaft. In such case, the shaft is a readily available conventional shaft and the receiving end of the assembly should be adapted with easily connectable means, such as holes, to receive the shaft after insertion.

The previous discussions and embodiments are ways to control the hitting face inclination angle of the Clubhead by means of centrifugal force. Another effective way is to take into ate account the large curvature of the long shaft during swinging. The latter is more of a mechanical linkage type enhancement than a dynamic manipulation. The concept is described in relation to the following example. When a long shaft bends and its curvature is changed along the length, the length of its neutral axis from one end, say at the end of the handle, to the other, say the connecting point of the shaft to the center of the clubhead, will not change. In this example, the clubhead can rotate freely about the axis of the associated hinge pin. The hinge pivot is preferably at the mass center of the clubhead and lies along the neutral axis of the shaft.

As now will be described, a parallelogram or a four-bar linkage is described wherein the length of the neutral axis along the shaft which does not change length during bending, is one of the two long parallel legs of the parallelogram. A thin flexible wire is provided, which is made of spring steel, or other stiff but flexible materials having one of its ends anchored to a point at the head a small distance away from the binge axis and the other end running down the shaft, following closely the inside wall of the shaft along the side of the shaft which is in most compression during bending. This end is anchored at the wall at the end of the handle.

The plane containing the wire and the neutral axis of the shaft should coincide with the plane in which the curved shaft lies when the golf club is being swung. This wire which connects the clubhead to the handle is the other long leg of the parallelogram. Since their lengths are about equal and the length of the wire is not allowed to change, they will remain parallel approximately, even though both will be curved during bending of the shaft. A spring device, such as a coil spring may be installed at the hinge so that the clubhead is always under a torsional moment to rotate counterclockwise, as shown in FIG. 11A. The rotation is being stopped by the presence of the torsioned wire, which ties the head to the handle, as described. A way to adjust the head is pulling the wire at the end of the handle against the spring force until the inclination of the hitting face of the clubhead is at the correct orientation, for example, parallel to the axis of the handle. Then have the end of the wire fixed at the handle. The straight shaft with upright clubhead and also the curved shaft are shown in FIG. 11A.

FIG. 11A shows a preferred embodiment. In this figure, 101 is the clubhead which has a hinge 102. The axis of the hinge is perpendicular to the paper. The clubhead, a swivel head, can rotate about the axis of the hinge 102. The shaft 103 extends into the head and contains the hinge. The item 104 is the handle portion of the shaft. The dotted line neutral axis 105 is shown in its straight and also in its bent position. A wire 106 is installed along the inside wall 107 of the shaft, parallel and following the wall, as shown. End 108 of the wire 106 is anchored at a small distance from hinge 102. In FIG. 11A, the top of the shaft is partially removed to show the anchor made at the clubhead. It is preferred that the line joining 102 and 108 be approximately perpendicular to the hitting face 109 as shown which is parallel to the axis of the handle. The other end 110 of the wire is at the end of the handle. A simple mechanical device, such as a screw not shown, may be installed to adjust the length of the wire before it is fixed. In connection with this adjustment, one can adjust the inclination angle of the hitting face of the head manually by pulling the wire from the handle side through an opening in the handle, or by adjusting the torque on the clubhead through an opening at the head.

The three points 102, 108, 110, and an imaginary point 111 at the neutral axis, form approximately the parallelogram described above. Such a four-bar linkage will have the upper short side, 102 to 108, always approximately in parallel with the base side, 110 to 111, either when the long legs are straight or in curved shape, because the long legs are approximately of equal length when the shaft is straight or in curved shape. The wire will rest and slide along upon the curved wall when the shaft is bent. The four-bar linkage will swing evenly with the two long legs approximately parallel. This parallelogram keeps the hitting face of the clubhead always approximately parallel to the axis of the handle no matter how much the shaft is bent due to CA the swinging of the golf club.

An exact analysis was performed to find the hitting face inclination angle for the steel golf club shown in FIG. 1 and FIG. 3A. The length of the shaft, 111 to 102, is 90 cm, the inside radius of the handle, 110 to 111, is 7.0 mm, the wall thickness is 0.5 mm, and the radius of the small end, 102 to 108, is 4.0 mm, When the shaft is straight, the inclination angle of the hitting face, which is parallel to the axis of the handle, is adjusted and taken as zero degree. The shaft is progressively being swung at large curvature amplitude. Column 1 below illustrates typical hitting face inclination angles for the conventional golf club at different swing amplitudes. Colummn 2illustrates corresponding hitting face angles for the golf club embodying the present inventive swivel head.

| Column 1<br>Conventional Head | Column 2<br>Inventive Swivel Head |
|---|---|
| 3.4 degress | 1.0 degress |
| 9.2 degress | 1.8 degress |
| 11.9 degress | 2.6 degress |
| 17.6 degress | 3.4 degress |
| 22.0 degress | 3.7 degress |

From the foregoing results, it is clear that the parallelogram of the swivel head makes the hitting face approximately parallel to the axis of the handle at all times during the swinging of the golf club.

FIG. 11B illustrates the side view of FIG. 11A which shows a single wire 106 anchored at the handle point 110. In another embodiment as shown in FIG. 11C, a side view is illustrated as having a different arrangement of the wire than in FIG. 11A. FIG. 11C shows the wire running down to the handle point 110, but instead of being anchored at that point, it turns around a turning device 112, which is shown simply as a bearing device. The plane containing the turning device is parallel to the inside wall of the shaft, so that in viewing from FIG. 11A, the plane coincides with the point 110. In this arrangement, the wire 106 runs upwards to become 113 and anchors at a point 114, along the inside wall of the shaft.

The new arrangement with upturned length enables the anchor point 114 to displace downward due to the compressive shortening of the wall 107 which releases the length of the wire to let the anchor point 108 to rotate upward as much as it can. If point 114 anchored as high as possible to the frame, the turning angle of the hitting face will be twice as large as the case with the wire stopping at the point 110. Of course, it not desirable to have this latter situation, but the FIG. 11C arrangement may serve as an optimization to adjust the compensation to favor a certain range of swinging or to the limitation imposed by the geometry of the clubhead.

FIGS. 11A, 11B and 11C illustrate various arrangements of the preferred embodiment, but it will be understood that details may vary and still remain within the scope of the invention. For example, the wire 106 may be placed at the opposite side of the shaft. But since the wire has to follow the contour of the inside wall at all times, it may need a device to push the wire against the wall when the shaft is bent.

What is claimed is:

1. A golf club comprising:

a head device having a hitting face providing an impact surface arranged for striking a ball during play, a shaft having two ends with a handle at one end and said head device at the other end thereof, said head device being turnably joined to said other end of said shaft, and a wire device operatively connected to both said head device and said shaft; said wire device allowing said shaft to bend in a direction generally opposite to the intended direction of a struck golf ball during a downswing, wherein a general shaft curvature is defined; said wire device having means for turning said head device in a direction generally opposite to the direction of the general curvature of the shaft as viewed from the plane of movement of said head device being projected to the swing plane of the golf club when said shaft is being bent due to the swinging of the golf club during a downswing and just prior to the impact of the hitting face with a golf ball.

2. A golf club according to claim 1 wherein said wire device comprises at least a wire having opposite end, one end of which is connected to said head device, the other end being connected to said shaft.

3. A golf club according to claim 2 wherein said shaft has a neutral axis, said neutral axis and said wire constituting the two opposite sides of a four-bar linkage of an approximate parallelogram and being arranged for maintaining said hitting face of said head device in an approximate parallel position with respect to the axis of said handle as said shaft is being bent due to the swinging of the golf club.

4. The golf club according to claim 2 wherein said shaft is hollow and has a neutral axis and said wire is approximately parallel to said neutral axis and runs along the inside wall of said shaft on the side there most compressed during bending of said shaft due to the swinging of the golf club.

5. The golf club according to claim 2 wherein said wire device comprises at least a torque device which exerts a torque on said head device to place tension on said wire.

6. The golf club according to claim 2 including means operatively associated with said wire for adjusting the inclination angle of said hitting face.

7. The golf club according to claim 5 wherein the golf club is formed with an opening and said means operatively associated with said wire being adapted for adjusting the inclination angle of said hitting face through said opening.

* * * * *